US005243710A

United States Patent [19]

Craycroft

[11] Patent Number: 5,243,710

[45] Date of Patent: Sep. 14, 1993

[54] LOCKABLY-RELEASABLE AQUAMARINE TETHERING DEVICE

[76] Inventor: Andrew S. Craycroft, 59-022 Oopuola, Haleiwa (Oahu), Hi. 96712

[21] Appl. No.: 937,393

[22] Filed: Aug. 31, 1992

[51] Int. Cl.[5] ..... A41F 9/00; B63B 35/85; B63B 21/04

[52] U.S. Cl. ..... 2/312; 2/311; 2/314; 2/317; 2/319; 2/338; 114/253; 441/69; 294/82.35; 24/115 F; 24/656; 403/DIG. 4

[58] Field of Search ..... 2/311, 312, 314, 317, 2/318, 319, 338; 114/253; 441/69; 294/82.35; 24/652, 656, 602, 115 F; 403/DIG. 4

[56] References Cited

U.S. PATENT DOCUMENTS 1,703,579 2/1929 Gaffner ..... 24/652
4,613,311 9/1986 Wood ..... 24/602
5,081,719 1/1992 Donnelly ..... 2/311

*Primary Examiner*—Clifford D. Crowder
*Assistant Examiner*—Gloria Hale
*Attorney, Agent, or Firm*—George R. Nimmer

[57] ABSTRACT

As is well-known in the prior art, flexible elongate rope-like tethers have a leadward-end attached to a leadwardly-impelled aquamarine equipment (e.g. surfboard, towed water-ski, etc.) and having a trailward-end securely attached to the towed operator (e.g. a surfboarder, a water-skier, etc.). It is also well known in the prior art that the aquamarine's tethered operator might find himself/herself in a visually discernible perilous situation and wherein the elongate tether should be disengaged from the towing aquamarine device. Accordingly, the present invention provides a vertical-pin type releasably-lockable device that has the required secure attachment to the operator's body, but wherein the operator can manually vertically withdraw the vertical-pin portion of a releasable-lockable device to quickly withdraw himself/herself from the leadwardly tethered aquamarine equipment whenever the operator somehow discerns a perilous condition.

9 Claims, 3 Drawing Sheets

LOCKABLY-RELEASABLE AQUAMARINE TETHERING DEVICE

BACKGROUND OF THE INVENTION

As is well known to participants of aquamarine activities (e.g. surfboard operator, water-ski operator, etc.) an elongate rope-like tether has its trailward-end attached to a girdle encirling the operator's arm, leg, or waist, and has its leadward-end attached to a water-borne tow (e.g. surfboard, motorboat tow for water-ski, etc.). Because of the velocity and/or sinuous path of the water-borne tow, the operator of the surfboard, water-ski, etc., can be subjected to a perilous condition e.g. wherein the tether begins to wrap about the operator's body. Such tether wrapping can cause severe injury, or even drowning. Prior workers in the aquamarine sports art have attempted to provided lockably-releasable tethering devices intended: to provide secure engagement between the tether and the operator's body girdle; but to enable the operator (somehow discerning a perilous condition) to quickly and reliably manually disengage the tether trailward-end from the body girdle. However, such attempts heretofore by prior art workers have been marginally acceptable, at best.

GENERAL OBJECTIVE OF THE INVENTION

In view of the foregoing, it is the general objective of the present invention to provide a releasably-lockable aquamarine tethering device that provides a secure engagement between the tether and the aquamarine operator's body girdle, but which body girdle is is equipped with a manual disengager for the tether and which is very quickly and reliably implementable by the operator whenever the operator visually discerns a sudden perilous condition such as, for example, becoming wrapped by the elongate rope-like tether.

GENERAL STATEMENT OF THE INVENTION

With the above general objectives in view, and together with other ancillary and specific objectives which will become more apparent as this description proceeds, the releasably-lockable aquamarine tethering device concept (e.g. 9) of the present invention generally comprises: an elongate flexible rope-like tether having a leadward-end (11) attachable to a selectable aquamarine equipment (AE) and having a trailward-end in the form of a horizontal tongue (14) having a vertical tongue-opening (15) therethrough; an operator's body girdle (20) adapted to removably and controllably adjustably tightly surround the leg, arm, or waist of the operator; extending rigidly horizontally outwardly from the body girdle, a socket (30) having a horizontal bore (31) for surrounding the tether tongue and having a preferably vertical socket-aperture (32) communicating with the socket horizontal bore; an anchoring station (40) for the body girdle and located alongside the socket-aperture; and locking means (50) extending securely (but manually removably) from the girdle anchoring station and including a lockpin (60)extending through the socket-aperture and through the tether's tongue-opening to thereby securely attach the body girdle to the elongate tether, and the locking means being provided with a manually engageable pull (70) whereby the locking means (50 (40, 60, 70)) is manually releasable from the girdle socket's normally-attached elongate tether whenever the operator visually discerns a perilous aquamarine situation.

BRIEF DESCRIPTION OF THE DRAWING

In the drawing, wherein like characters refer to like parts in the several views, and in which.

DETAILED DESCRIPTION OF THE DRAWING

Figure 1:
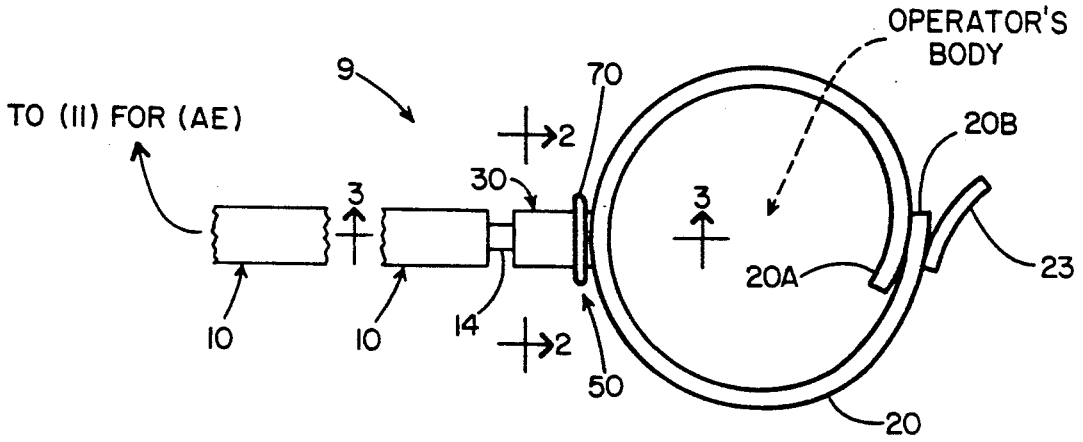
FIG. 1 is a schematic top plan view of a representative embodiment (9) of the releasably-lockable aquamarine tethering device of the present invention and extending between a selectable aquamarine equipment (AE) and the girdle (20) for the equipment operator.

Supplementing and amplifying the general statement of the invention hereabove, the general concept (9) for the releasably-lockable aquamarine tethering device herein, a detailed description of its various permissible components (10, 20, 30, 40, 50, 60, and 70) are treated in the ensuing descriptive paragraphs, as follows:

The operator's body girdle (20) might take the form of a strap-like fabric material having two free-ends 20A and 20B. For the purpose of controllably tightly adjusting the body girdle about the operator's leg, arm, or waist, VELCRO or hook and loop type fastener means (21A, 21B) is preferred; one hooks or loops alpha-component (21A) being adhesively attached (22A) to girdle free-end portion (20A) and another eyes or hooks beta-component (21B) being adhesively attached (22B) to the other free-end portion (20B). One of such girdle free-ends might have a sewn (23C) disengager-strap 23 for manually disengaging the girdle free-ends (20A, 20B) from the operator's body.

Attached to and extending rigidly horizontally outwardly from the body girdle (20) is a socket 30 formed of durable plastic (or other hard material) and which socket has a horizontal bore 31 for slidably surrounding tether tongue 14 and has a preferably vertical socket-aperture communicating with the said horizontal bore 31. Socket 30 is herein shown rigidly attached to body girdle 20 with a strong adhesive 30A.

(However, a rivet (or the like) might be alternatively employed for such socket-to-girdle rigid attachment).

There is an anchoring station (e.g. 40, 41A) attached to said girdle 20 overlying (or otherwise adjacently located with respect to) socket-apertured portion (32). For example, such anchoring means might comprise the hooks or loops first-component (41A) of a dual-components type VELCRO or hook and loop fastener means and which strip-like first-component can be adhesively attached (42A) to body girdle 20.

There is a locking means (50) extending securely (but manually removably) downwardly extending from anchoring station (40) as a vertical lockpin (60) extending through said socket-aperture (e.g. 32) and through said tongue-opening (15) to thereby securely attach body girdle socket 30 to the tether's trailward-end tongue 14 (at 15). The said locking means (50, at 60) is topically provided with a manually engageable pull (e.g. annular D-ring 70) for the socketed (50) tether (10, 14–15). Thus, whenever, the operator visually discerns a perilous aquamarine situation, the operator might manually pull upon the pull component (70) to withdraw the locking means from the girdle anchoring portion and from the tongue-opening (15) to disengage the body girdle from the aquamarine tether. In the foregoing vein, a flexible web 65 might connect the horizontal flanges (61) of a vertical lockpin 60 to annular pull 70, and an loops or hooks second-component 41B (for first-component (41A) might be adhesively attached (41B) to the web 65.

Figure 2:
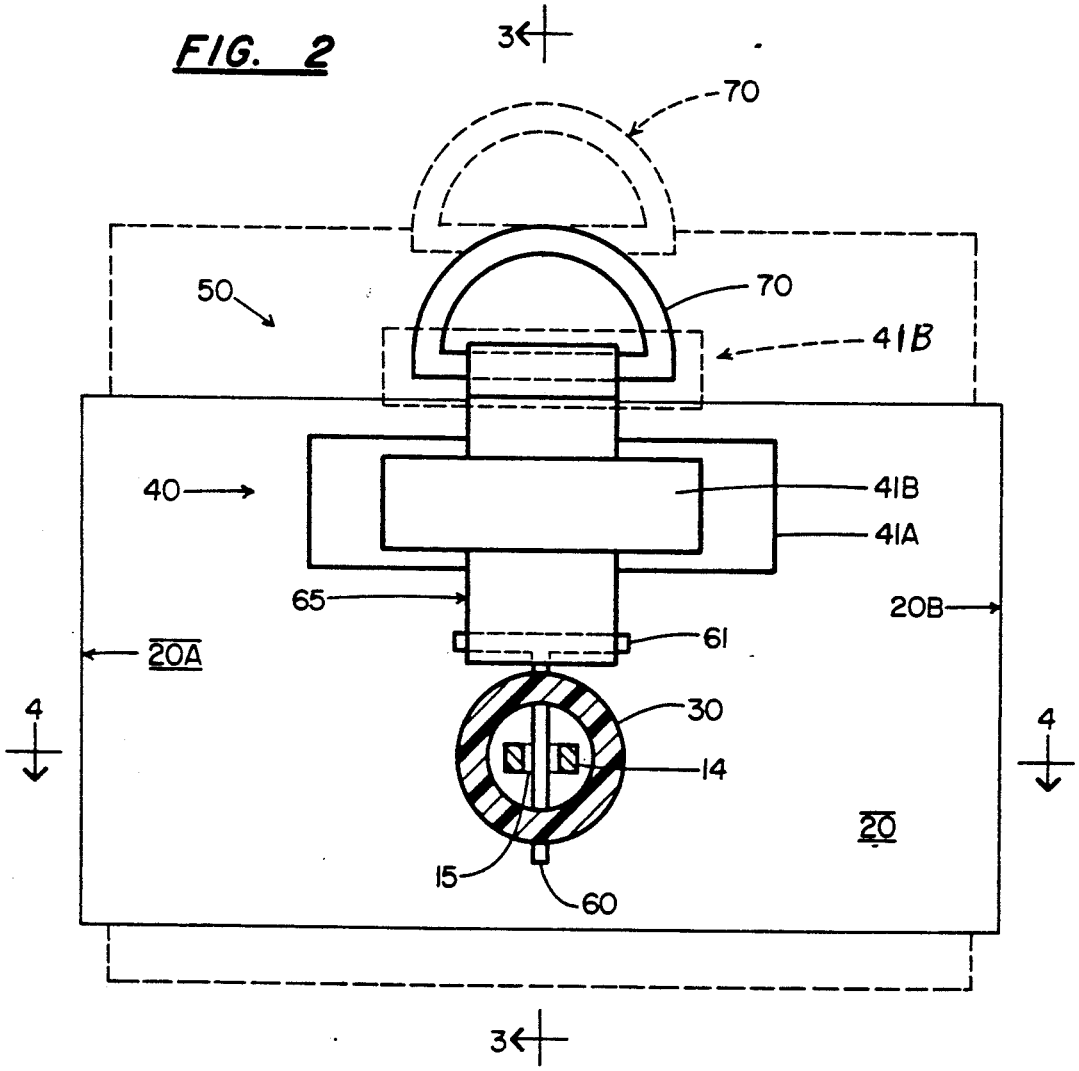
FIG. 2 is a sectional elevational view taken along lines 2—2 of FIGS. 1, 3, and 4.
Figure 3:
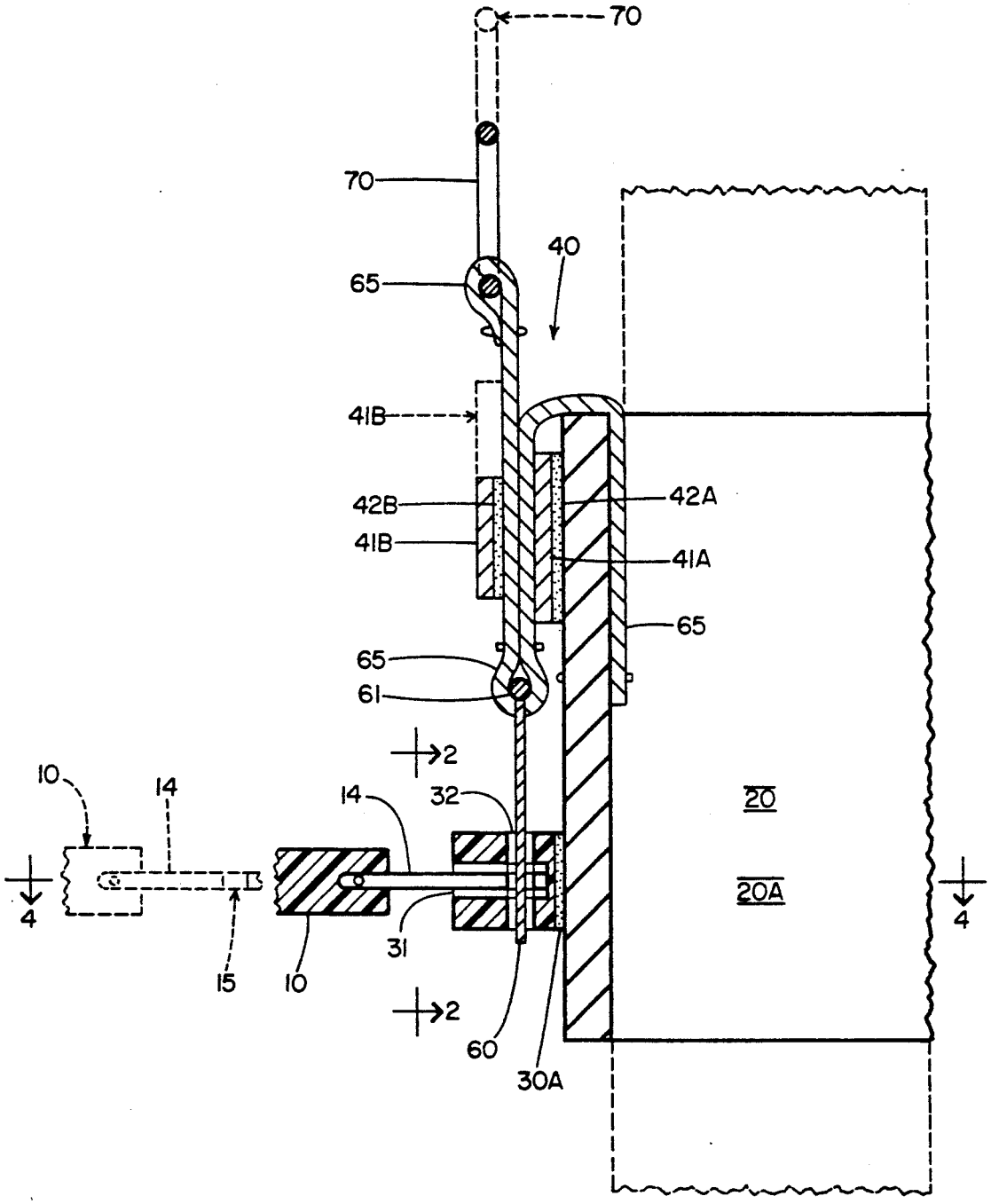
FIG. 3 is a sectional elevational view taken along lines 3—3 of FIGS. 1, 2, and 4.
Figure 4:
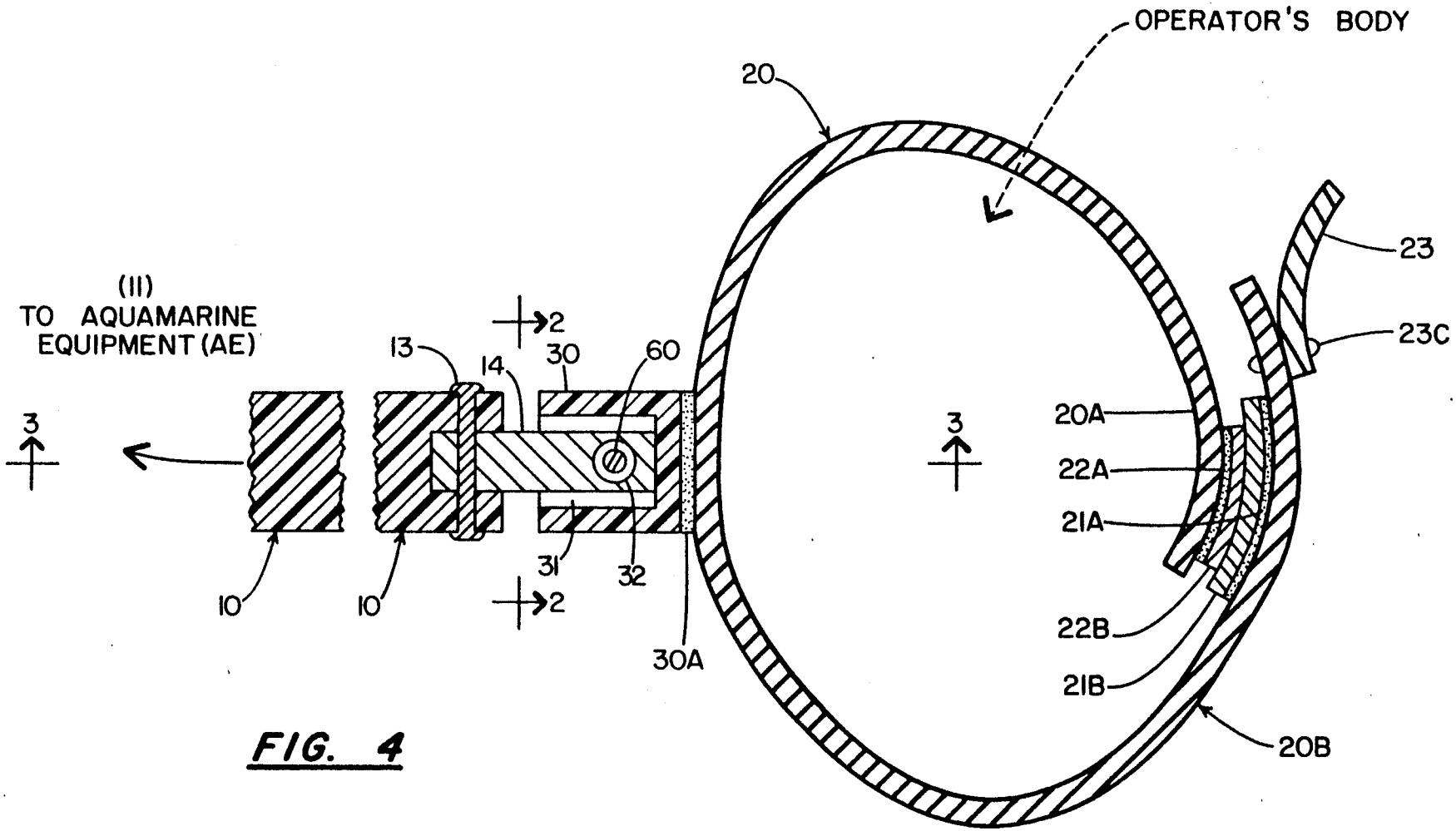
FIG. 4 is a sectional plan view taken along lines 4—4 of FIGS. 2 and 3.

Accordingly, as seen in the FIGS. 1, 3, and 4 solid lines conditions for the tether trailward-end (e.g. tongue 14): the tether trailward-end has the required secure engagement with the operator's body girdle (20) and will remain secure so long as the operator deems the aquamarine equipment (at the tether ends) is functioning safely. However, as seen in the FIGS. 2 and 3 phantom lines conditions for the body girdle's manual pull (70) and for tether tongue (14): whenever the operator visually discerns a perilous condition, he/she can pull upwardly (at 70) whereupon the associated lockpin (60) will withdraw from tether trailward-end 14, and the elongate tether (10) will become disengaged from the operator's body girdle.

From the foregoing, the construction and operation of the releasably-lockable aquamarine tethering device will be readily understood and further explanation is believed to be unnecessary. However, since numerous modifications and changes will readily occur to those skilled in the art, it is not desired to limit the invention to the exact construction shown and described, except as specifically recited in the appended claims.

I claim:

1. Releasably-lockable aquamarine tethering device extending between an aquamarine equipment and the human operator therefor, and comprising:

(A) an elongate flexible rope-like tether having a leadward-end attachable to selectable aquamarine equipment and having a trailward-end provided with a horizontal tongue having a vertical tongue-opening;

(B) an operator's body girdle adapted to removably and controllably tightly surround the leg, arm, or waist of the operator;

(C) attached to and extending outwardly from said body girdle, a horizontal tubular socket having a horizontal bore adapted to slidably surround said tether horizontal tongue and having a vertical socket-aperture communicating with said horizontal bore;

(D) an anchoring station attached to said girdle and overlying said socket-aperture; and (E) locking means removably securable and extending downwardly from said girdle anchoring station and including a vertical lockpin extending vertically downwardly through said socket-aperture and through said tongue-opening to thereby securely attach said body girdle to said rope-like tether's tongue, and said securely downwardly extending locking means being topically provided with a manually engageable pull whereby said locking means is manually releasable from said tether whenever the operator visually discerns a perilous aquamarine situation.

2. The releasably-lockable aquamarine tethering device of claim 1 wherein said anchoring station comprises the hooks or loops first-component of a hook and loop fastening means carried by said body girdle; wherein said vertical lockpin includes upper horizontal flanges; and wherein a flexible web connects the horizontal flanges of said lockpin to said manually engageable pull, and said web carrying the loops or hooks second-component of a said hook and loop fastening means.

3. The tethering device of claim 2 wherein the locking means topical manual pull is of D-shaped annular configuration.

4. The releasably-lockable aquamarine tethering device of claim 1 wherein the girdle has two free-ends and is thereby controllably adjustably tightenable about the operator's body.

5. The device of claim 4 wherein hook and loop type fastening means is carried at the respective free-ends of the girdle.

6. The releasably-lockable aquamarine tethering device of claim 1 wherein the socket extends rigidly outwardly from the body girdle.

7. The device of claim 6 wherein the body girdle is made of flexible strap-like material and the socket is adhesively connected to and rigidly extends outwardly from the body girdle.

8. Releasably-lockable aquamarine tethering device extending between an aquamarine equipment and the operator therefor and comprising:

(A) an elongate flexible rope-like tether having a leadward-end attachable to selectable aquamarine equipment and having a trailward-end provided with a horizontal tongue having a tongue-opening;

(B) an operator's body girdle adapted to removably and controllably tightly surround the leg, arm, or waist of the operator;

(C) attached to and extending outwardly from said body girdle, a horizontal tubular socket having a horizontal bore adapted to slidably surround said tether horizontal tongue and having a socket-aperture communicating with said horizontal bore;

(D) an anchoring station for said body girdle and located adjacent said socket-aperture; and (E) locking means removably securable and extending from said girdle anchoring station and including a lockpin extending through said socket-aperture and through said tongue-opening to thereby securely attach said body girdle to said tether's tongue, and said locking means being provided with a manually engageable pull whereby said locking means is manually releasable from said tether whenever the operator visually discerns a perilous aquamarine situation.

9. The releasably-lockable aquamarine tethering device of claim 8 wherein the locking means pull is of annular shape; and wherein said anchoring station comprises the hooks or loops first-component of a hook and loop fastening means, and said locking means carries the loops or hooks second-component of said hook and loop fastening means.

* * * * *